US010851313B2

(12) United States Patent
Ida et al.

(10) Patent No.: US 10,851,313 B2
(45) Date of Patent: Dec. 1, 2020

(54) METHOD OF PRODUCING LOWER OLEFIN AND MONOCYCLIC AROMATIC HYDROCARBON HAVING 6 TO 8 CARBON ATOMS AND DEVICE FOR PRODUCING LOWER OLEFIN AND MONOCYCLIC AROMATIC HYDROCARBON HAVING 6 TO 8 CARBON ATOMS

(71) Applicants: JXTG Nippon Oil & Energy Corporation, Tokyo (JP); Chiyoda Corporation, Yokohama (JP)

(72) Inventors: Ryoji Ida, Tokyo (JP); Yasuyuki Iwasa, Tokyo (JP); Masahide Kobayashi, Tokyo (JP); Yukihiro Yoshiwara, Tokyo (JP); Shinichiro Yanagawa, Tokyo (JP); Yasuhiro Watanabe, Yokohama (JP); Takashi Aozasa, Yokohama (JP); Shinji Hyodo, Yokohama (JP)

(73) Assignees: ENEOS CORPORATION, Tokyo (JP); CHIYODA CORPORATION, Kanagawa (JP)

( * ) Notice: Subject to any disclaimer, the term of this patent is extended or adjusted under 35 U.S.C. 154(b) by 0 days.

(21) Appl. No.: 16/318,539

(22) PCT Filed: Jul. 12, 2017

(86) PCT No.: PCT/JP2017/025380

§ 371 (c)(1),
(2) Date: Jan. 17, 2019

(87) PCT Pub. No.: WO2018/016397

PCT Pub. Date: Jan. 25, 2018

(65) Prior Publication Data

US 2019/0316048 A1 Oct. 17, 2019

(30) Foreign Application Priority Data

Jul. 20, 2016 (JP) ..... 2016-142571

(51) Int. Cl.
*C10G 11/05* (2006.01)
*C10G 63/04* (2006.01)
(Continued)

(52) U.S. Cl.
CPC ..... *C10G 11/05* (2013.01); *C10G 11/10* (2013.01); *C10G 63/04* (2013.01); *C10G 7/00* (2013.01);
(Continued)

(58) Field of Classification Search
CPC ... C10G 11/05; C10G 11/10; C10G 11/14–18; C10G 2300/1051; C10G 2300/1059; C10G 2400/20; C10G 2400/30
See application file for complete search history.

(56) References Cited

U.S. PATENT DOCUMENTS 5,827,422 A * 10/1998 Drake ..... B01J 29/06 208/135
2008/0035527 A1* 2/2008 Eng ..... C10G 11/18 208/113
(Continued)

FOREIGN PATENT DOCUMENTS

JP 2012-505949 A 3/2012
JP 2014-505669 A 3/2014
(Continued)

OTHER PUBLICATIONS

Extended European Search Report dated Jan. 24, 2020 in EP Application No. 17830916.7.
(Continued)

*Primary Examiner* — Renee Robinson
(74) *Attorney, Agent, or Firm* — Panitch Schwarze Belisario & Nadel LLP

(57) ABSTRACT

A method of producing a lower olefin and BTX from stock oils selected from at least two kinds of oils is provided. The method includes a first catalytic cracking step of bringing one stock oil A into contact with a catalytic cracking catalyst; a second catalytic cracking step of bringing one stock oil B, having an aromatic component content smaller than that of the stock oil A, into contact with the catalytic cracking catalyst; and a separation and collection step of collecting the lower olefins and BTX from a product generated in the first and second catalytic cracking steps. A contact time A during which the stock oil A is in contact with the catalytic cracking catalyst in the first catalytic cracking step is longer than a contact time B during which the stock oil B is in contact with the catalytic cracking catalyst in the second catalytic cracking step.

4 Claims, 3 Drawing Sheets

(51) Int. Cl.
*C10G 11/10* (2006.01)
*C10G 7/00* (2006.01)

(52) U.S. Cl.
CPC ..... *C10G 2300/1051* (2013.01); *C10G 2300/1059* (2013.01); *C10G 2300/4081* (2013.01); *C10G 2400/20* (2013.01); *C10G 2400/30* (2013.01)

(56) References Cited

U.S. PATENT DOCUMENTS

| | | | | |
|---|---|---|---|---|
| 2009/0288985 | A1* | 11/2009 | Long ..... | C10G 69/02 208/57 |
| 2011/0062054 | A1 | 3/2011 | Gao et al. | |
| 2011/0207979 | A1 | 8/2011 | Kim et al. | |
| 2013/0006028 | A1* | 1/2013 | Xie ..... | C10G 11/18 585/302 |
| 2013/0056393 | A1 | 3/2013 | Subramani et al. | |
| 2013/0062250 | A1 | 3/2013 | Gao et al. | |
| 2013/0253242 | A1 | 9/2013 | Kim et al. | |
| 2013/0292298 | A1 | 11/2013 | Shi | |
| 2014/0018585 | A1 | 1/2014 | Yanagawa et al. | |
| 2015/0259610 | A1 | 9/2015 | Yanagawa et al. | |

FOREIGN PATENT DOCUMENTS

| | | | |
|---|---|---|---|
| WO | 2005/085391 | A1 | 9/2005 |
| WO | 2009089681 | A1 | 7/2009 |
| WO | 2010/044562 | A2 | 4/2010 |
| WO | 2014/065419 | A1 | 5/2014 |

OTHER PUBLICATIONS

Int'l Search Report and Written Opinion dated Aug. 15, 2017 in Int'l Application No. PCT/JP2017/025380.

Notice of Allowance dated Mar. 24, 2020 in JP Application No. 2016142571.

* cited by examiner

METHOD OF PRODUCING LOWER OLEFIN AND MONOCYCLIC AROMATIC HYDROCARBON HAVING 6 TO 8 CARBON ATOMS AND DEVICE FOR PRODUCING LOWER OLEFIN AND MONOCYCLIC AROMATIC HYDROCARBON HAVING 6 TO 8 CARBON ATOMS

CROSS-REFERENCE TO RELATED APPLICATION

This application is a Section 371 of International Application No. PCT/JP2017/025380, filed Jul. 12, 2017, which was published in the Japanese language on Jan. 25, 2018, under International Publication No. WO 2018/016397 A1, which claims priority under 35 U.S.C. § 119(b) to Japanese Patent Application No. 2016-142571, filed on Jul. 20, 2016, the disclosures of which are incorporated herein by reference in their entireties.

TECHNICAL FIELD

The present invention relates to a method of producing a lower olefin and a monocyclic aromatic hydrocarbon having 6 to 8 carbon atoms and a device for producing a lower olefin and a monocyclic aromatic hydrocarbon having 6 to 8 carbon atoms.

Priority is claimed on Japanese Patent Application No. 2016-142571, filed on Jul. 20, 2016, the content of which is incorporated herein by reference.

BACKGROUND ART

In recent years, various examinations for contributing to effective use of petroleum by using fractions, which have been used for heavy oils or the like and have low added value, as raw materials of products having high added value, such as ethylene, propylene, and butene (hereinafter, these are collectively referred to as "lower olefins") and monocyclic aromatic hydrocarbons having 6 to 8 carbon atoms (benzene, toluene, xylene, and ethylbenzene, hereinafter, these are collectively referred to as "BTX").

For example, a technology of efficiently producing BTX and lower olefins, which can be used as a high octane number gasoline base material or a petrochemical raw material, using light cycle oil (also referred to as light cycle oil, hereinafter, referred to as "LCO"), generated by a fluidized catalytic cracker (hereinafter, referred to as "FCC") which has been mainly used as a heavy oil base material, as a raw material has been suggested.

PTL 1 describes a method of obtaining an aromatic product with a high concentration and a light olefin-containing product with high added value from LCO. In PTL1, LCO is decomposed by a catalytic cracking catalyst, and the decomposed components are separated into an aromatic component selected from benzene, toluene, and xylene, an olefin component, and a mixed aromatic component having two or more aromatic rings. Thereafter, a step of performing a hydrogenation treatment on the mixed aromatic component having two or more aromatic rings and returning the step to the decomposition step is carried out.

Further, PTL 2 describes a method of catalytically cracking LCO so that benzene, toluene, and a component having 9 or more carbon atoms are separated, and transalkylating these components to obtain an aromatic component with high added value such as xylene.

CITATION LIST

Patent Literature

[PTL 1] Published Japanese Translation No. 2012-505949 of the PCT International Publication

[PTL 2] Published Japanese Translation No. 2014-505669 of the PCT International Publication

SUMMARY OF INVENTION

Technical Problem

LCO obtained from FCC highly contains aromatic components, but also contains non-aromatic components. Here, the non-aromatic components contain a chain-like saturated hydrocarbon represented by Molecular Formula $C_nH_{2n+2}$, a cyclic saturated hydrocarbon represented by Molecular Formula $C_nH_{2n}$ (hereinafter, also collectively referred to as "saturated components"), a chain-like olefin compound represented by Molecular Formula $C_nH_{2n}$, and the like.

According to the conventional methods of producing BTX or olefins described in PTLs 1 and 2, LCO used as a raw material also contains, in addition to aromatic components, oil that contains non-aromatic components.

Among compounds contained in LCO, a monocyclic aromatic component has a relatively high selectivity because the monocyclic aromatic component can be converted to BTX by decomposing a side chain of an aromatic ring at the time of conversion into BTX. Further, a bicyclic aromatic component such as a naphthalene ring can be efficiently converted to BTX by performing partial hydrogenation because the bicyclic aromatic component can be converted to a monocyclic aromatic component through partial hydrogenation. Moreover, in order to obtain BTX from non-aromatic components particularly in a state in which aromatic components coexist, the non-aromatic components are converted to BTX simultaneously with decomposition of a side chain of a monocyclic aromatic component. For this purpose, it is necessary to carry out a step of catalytically cracking non-aromatic components using a catalyst, and cyclizing and dehydrogenating the resulting components.

BTX can be obtained by performing this step, but it is known that lower paraffin having 1 to 4 carbon atoms, in other words, LPG and gas fractions are largely produced as by-products because of a side reaction of a hydrogenation reaction or over decomposition.

Accordingly, in a case where the conventional techniques are applied to oil containing a larger amount of non-aromatic components than that of LCO, there is a problem in that the total yield of target petrochemical products such as BTX and lower olefins is not sufficient and LPG and gas fractions with low added value are largely produced as by-products.

The present invention has been made in consideration of the above-described circumstances, and an object thereof is to provide a method of producing a lower olefin and a monocyclic aromatic hydrocarbon having 6 to 8 carbon atoms, in which BTX and a lower olefin are produced with a high yield even in a case where oil containing a large amount of non-aromatic components is used and generation of gas as a by-product is suppressed; and a device for producing the same.

Solution to Problem

As the result of intensive examination conducted by the present inventors, it was found that, in a reaction of decomposing non-aromatic components using a catalyst and cyclizing the decomposed components to produce BTX, olefins are produced immediately after the non-aromatic components are brought into contact with the catalyst. Therefore, the present inventors thought that the non-aromatic components are used as the raw material of olefins, thereby completing the present invention. Non-aromatic components have been considered as components which can be converted to BTX particularly in a state in which aromatic components coexist, but have a lower BTX selectivity because LPG and gas fractions are largely produced as by-produced due to the side reaction. As the result of examination conducted by the present inventors, even in a case where petrochemical products are produced from oil having a larger content of non-aromatic components than that of LCO, lower olefins and BTX can be obtained with a high yield, generation of LPG and gas as by-products can be suppressed, and thus the non-aromatic components can be effectively used as the raw materials of petrochemical products with high added value.

According to a first aspect of the present invention, there is provided a method of producing a lower olefin and a monocyclic aromatic hydrocarbon having 6 to 8 carbon atoms from stock oils selected from at least two or more kinds of oils, the method including: a first catalytic cracking step of bringing one stock oil A among the stock oils into contact with a catalytic cracking catalyst; a second catalytic cracking step of bringing one stock oil B, having an aromatic component content smaller than that of the stock oil A, among the stock oils into contact with the catalytic cracking catalyst; and a separation and collection step of collecting the lower olefins and the monocyclic aromatic hydrocarbons having 6 to 8 carbon atoms from a product generated in the first and second catalytic cracking steps, in which a contact time A during which the stock oil A is in contact with the catalytic cracking catalyst in the first catalytic cracking step is longer than a contact time B during which the stock oil B is in contact with the catalytic cracking catalyst in the second catalytic cracking step.

In the present invention, it is preferable that the stock oil A contains 50% by mass or greater of the aromatic component.

In the present invention, it is preferable that the stock oil B contains 15% by mass or greater of a non-aromatic component.

In the present invention, it is preferable that the contact time B is in a range of 0.1 seconds to 5.0 seconds.

In the present invention, it is preferable that the contact time A is in a range of 10 seconds to 300 seconds.

In the present invention, it is preferable that the stock oil A contains heavy fractions having 9 or more carbon atoms collected in the separation and collection step.

In the present invention, it is preferable that the method further includes a step of producing benzene or xylene from toluene among the collected monocyclic aromatic hydrocarbons having 6 to 8 carbon atoms after the separation and collection step.

In the present invention, it is preferable that the catalytic cracking catalyst is a catalyst containing crystalline aluminosilicates.

According to a second aspect of the present invention, there is provided a device for producing a lower olefin and a monocyclic aromatic hydrocarbon having 6 to 8 carbon atoms from stock oils selected from at least two or more kinds of oils, the device including: first catalytic cracking means for bringing one stock oil A among the stock oils into contact with a catalytic cracking catalyst; second catalytic cracking means for bringing one stock oil B, having an aromatic component content smaller than that of the stock oil A, among the stock oils into contact with the catalytic cracking catalyst; and separation and collection means for collecting the lower olefins and the monocyclic aromatic hydrocarbons having 6 to 8 carbon atoms from a product generated in the first and second catalytic cracking steps, in which a contact time A during which the aromatic component is in contact with the catalytic cracking catalyst in the first catalytic cracking step is longer than a contact time B during which a non-aromatic component is in contact with the catalytic cracking catalyst in the second catalytic cracking step.

Advantageous Effects of Invention

According to the present invention, it is possible to provide a method of producing a lower olefin and BTX, in which BTX and a lower olefin are produced with a high yield and generation of gas as a by-product is suppressed; and a device for producing a lower olefin and BTX.

DESCRIPTION OF EMBODIMENTS

<Method of Producing Lower Olefin and BTX>

Preferred embodiments of a method of producing a lower olefin and BTX of the present invention will be described.

The present invention is not limited to the following embodiments.

First Embodiment

According to a first embodiment, there is provided a method of producing a lower olefin and a monocyclic aromatic hydrocarbon having 6 to 8 carbon atoms from stock oils selected from at least two or more kinds of oils, the method including: a first catalytic cracking step of bringing one stock oil A among the stock oils into contact with a catalytic cracking catalyst; a second catalytic cracking step of bringing one stock oil B, having an aromatic component content smaller than that of the stock oil A, among the stock oils into contact with the catalytic cracking catalyst; and a separation and collection step of collecting the lower olefins and the monocyclic aromatic hydrocarbons having 6 to 8 carbon atoms from a product generated in the first and second catalytic cracking steps, in which a contact time A during which the stock oil A is in contact with the catalytic cracking catalyst in the first catalytic cracking step is longer than a contact time B during which the stock oil B is in contact with the catalytic cracking catalyst in the second catalytic cracking step.

Figure 1:
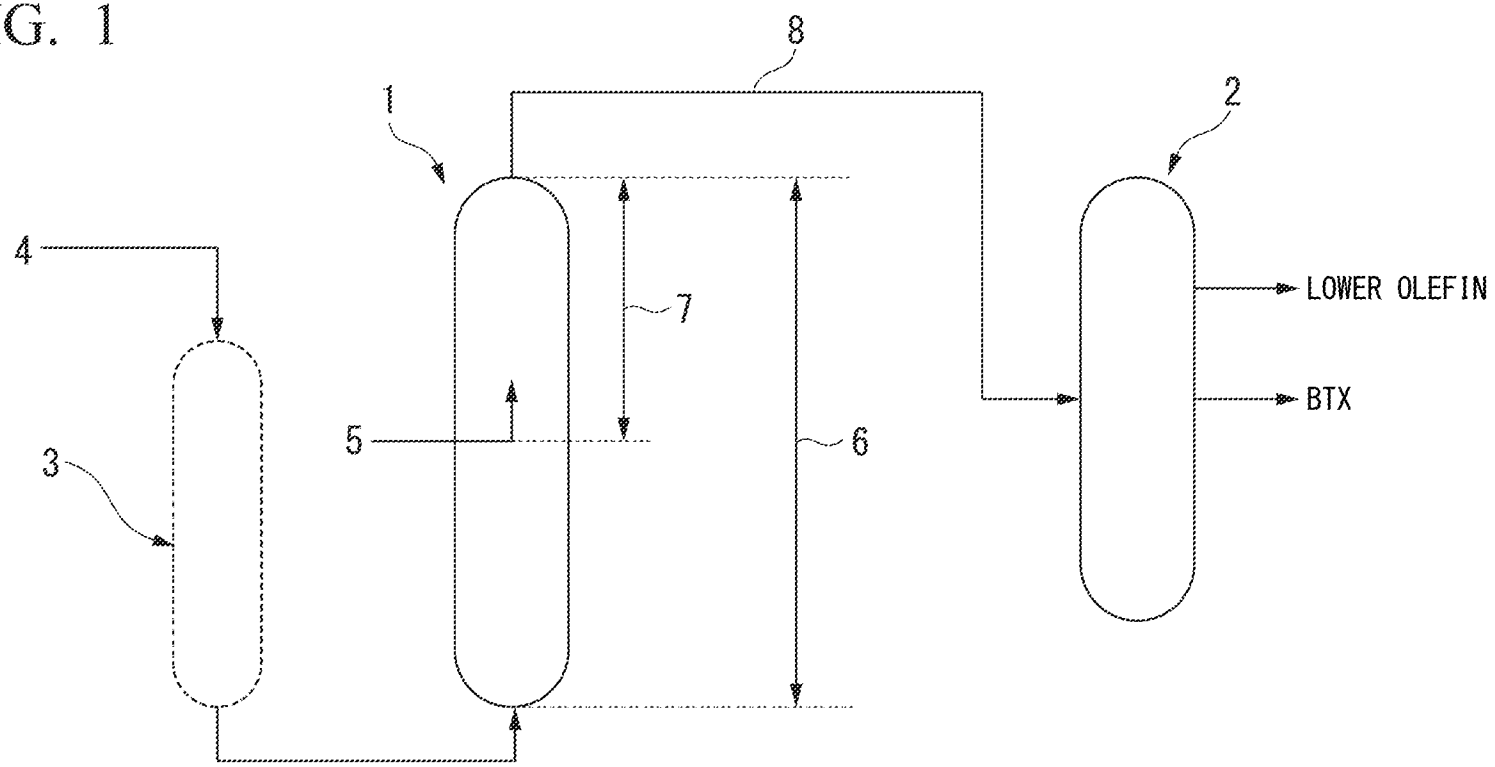
FIG. 1 is a schematic view for describing an embodiment of a device for producing a lower olefin and BTX according to the present invention.

FIG. 1 is a schematic view for describing an embodiment of a device for producing a lower olefin and BTX according to the present invention.

First, the schematic configuration of the embodiment of the device for producing a lower olefin and BTX according to the present invention and the processes according to the production method of the present invention will be described with reference to FIG. 1.

The device for producing a lower olefin and BTX according to the present embodiment includes a reaction tower 1 in which a catalytic cracking reaction is carried out; and a collection system 2 which separates and collects the product obtained in the reaction tower 1. The reaction tower 1 includes an aromatic component reaction region 6 and a non-aromatic component reaction region 7. The product obtained in the reaction tower 1 is transferred to the collection system 2 through a product transfer line 8. In the present embodiment, a hydrogenation reaction device 3 which performs a hydrogenation reaction step may be provided in front of the reaction tower 1.

[Catalytic Cracking Step]

A catalytic cracking step includes the first catalytic cracking step of bringing one stock oil A (hereinafter, referred to as the "stock oil A") among the stock oils selected from at least two or more kinds of oils into contact with a catalytic cracking catalyst; and the second catalytic cracking step of bringing one stock oil B (hereinafter, referred to as the "stock oil B"), having an aromatic component content smaller than that of the stock oil A, into contact with a catalytic cracking catalyst.

In the present embodiment, the contact time A during which the stock oil A is in contact with the catalytic cracking catalyst in the first catalytic cracking step is longer than the contact time B during which the stock oil B is in contact with the catalytic cracking catalyst in the second catalytic cracking step.

According to the present embodiment, the total yield of the lower olefin and BTX can be maximized while generation of by-products is suppressed, by changing the contact time between a stock oil, among stock oils to be passed, and a catalytic cracking catalyst in the catalytic cracking step according to the content of the aromatic components and the non-aromatic components.

Particularly, in the techniques of the related art, in a case where non-aromatic components are intended to be converted to BTX in the coexistence of aromatic components, the non-aromatic components can be converted to BTX by continuously performing the decomposition, cyclization, and dehydrogenation reaction. However, there is a problem in that the selectivity of BTX is low and LPG and gas such as lower paraffin are largely produced as by-products.

On the contrary, according to the present invention, generation of LPG and gas as by-products can be greatly suppressed.

(Stock Oil)

In the present specification, the "non-aromatic component" indicates a compound component which does not have an aromatic ring, and examples thereof include an aliphatic hydrocarbon. The aliphatic hydrocarbon may be a saturated component or an unsaturated component. Examples of the aliphatic hydrocarbon component include a linear or branched aliphatic compound and an aliphatic compound having a ring in the structure thereof. Examples of the aliphatic component include a linear aliphatic compound having 8 to 30 carbon atoms, a branched aliphatic compound having 8 to 30 carbon atoms, and an aliphatic compound having 8 to 30 carbon atoms and a ring in the structure thereof.

Examples of the non-aromatic component include a paraffin hydrocarbon which is a saturated compound component represented by Molecular Formula $C_nH_{2n+2}$, a naphthenic hydrocarbon having at least one saturated ring (naphthenic ring) in one molecule, and a chain-like olefin-based hydrocarbon represented by Molecular Formula $C_nH_{2n}$.

Further, the "aromatic component" indicates a monocyclic aromatic hydrocarbon or a polycyclic aromatic hydrocarbon. The polycyclic aromatic hydrocarbon includes a bicyclic aromatic hydrocarbon component and a tricyclic or higher cyclic aromatic hydrocarbon component. Examples of the monocyclic aromatic hydrocarbon component include benzenes such as alkylbenzene and naphthenobenzene. Examples of the bicyclic aromatic hydrocarbon component include naphthalenes such as naphthalene, methylnaphthalene, and dimethylnaphthalene. Examples of the tricyclic or higher cyclic aromatic hydrocarbon component include compounds having an anthracene skeleton, a phenanthrene skeleton, a pyrene skeleton, and the like.

As described above, the stock oils used in the present invention are selected from two or more kinds of oils, which are at least one stock oil A and one stock oil B having a smaller aromatic component content than that of the stock oil A.

As described above, the selectivity of monocyclic aromatic components is relatively high at the time of being converted to BTX. Meanwhile, polycyclic aromatic components are unlikely to be directly converted to BTX in the catalytic cracking step in a case where the hydrogenation reaction step is not carried out. Accordingly, in a case where oil containing a large amount of polycyclic aromatic components is used as a raw material, the polycyclic aromatic components may be partially hydrogenated before being subjected to the catalytic cracking step. Here, the partial hydrogenation before the catalytic cracking step is not necessarily performed even in a case where oil containing a large amount of polycyclic aromatic components is used. The details will be described in the section of the hydrogenation reaction step.

In the present specification, the expression "the stock oil B having a smaller aromatic component content than that of the stock oil A" means that the content of the aromatic components contained in the stock oil B is preferably 90% or less, more preferably 80% or less, and particularly preferably 70% or less with respect to the total amount of the aromatic components contained in the stock oil A.

In the present specification, the content of the aromatic components in the stock oil A is preferably 50% by mass or greater, more preferably 60% by mass or greater, and particularly preferably 70% by mass or greater. Further, the upper limit thereof is not particularly limited, but is preferably 90% by mass or less and more preferably 80% by mass or less.

Examples of oils containing a large amount of aromatic components include LCO, hydrogenated oil of LCO, naphtha cracker bottom oil, catalytic reformer bottom oil, coal-derived liquid, and heavy oil having 9 or more carbon atoms which is generated in the catalytic cracking step in the present specification.

The content of non-aromatic components in the stock oil B is preferably 15% by mass or greater, more preferably 20% by mass or greater, and particularly preferably 30% by mass or greater. Further, the upper limit thereof is not particularly limited, but is preferably 80% by mass or less, more preferably 70% by mass or less, and still more preferably 60% by mass or less. Further, the content of aromatic components in the stock oil B is preferably 10% by mass or greater and more preferably 20% by mass or greater.

In addition, the content of the aromatic components in the stock oil B is preferably 80% by mass or less, more preferably 70% by mass or less, and still more preferably 60% by mass or less.

Examples of oils containing a large amount of non-aromatic components include straight kerosene, straight light oil, coker kerosene, coker light oil, and hydrocracking heavy oil.

In the present invention, it is not necessary that the stock oil A and the stock oil B are formed of a single oil. For example, in a case of the stock oil A, LCO and coal-derived liquid may be mixed and used as the raw material.

However, it is necessary to pay attention to the combination of the contact time between each stock oil and the catalytic cracking catalyst. It should be noted that the effects of the present invention are decreased in a case where the combination of the contact time between each stock oil and the catalytic cracking catalyst is not correct, for example, the contact time between the stock oil B and the catalytic cracking catalyst is set to the contact time A which is preferable for the stock oil A.

In the present invention, the distillation properties of the stock oil to be used are not particularly limited, but there is a tendency that the amount of coke to be deposited on the catalytic cracking catalyst is increased and the catalytic activity is drastically degraded in a case where the boiling point of the stock oil is extremely high. Therefore, the stock oil has preferably a 90 volume % distillation point of 380° C. or lower and more preferably 360° C. or lower. Here, the "90 volume % distillation temperature" indicates a value measured in conformity with JIS K 2254 "Petroleum products—Determination of distillation characteristics".

(Contact Time)

In the contact time A between a stock oil 4 (stock oil A) and the catalytic cracking catalyst and the contact time B between a stock oil 5 (stock oil B) and the catalytic cracking catalyst, a method of setting the contact time A to be longer than the contact time B is illustrated in FIG. 1 as an example. As illustrated in FIG. 1, the first catalytic cracking step is performed by passing the stock oil 4 to the reaction tower 1 and using the entire region of the reaction tower 1 as the aromatic component reaction region 6. Further, the second catalytic cracking step is performed by passing the stock oil 5 through from the middle of the reaction tower 1 and using a portion of the reaction tower 1 as the non-aromatic component reaction region 7. In this manner, the contact time A can be set to be longer than the contact time B.

In a case of using this method, the specific position of passing the stock oil 5 may be appropriately set depending on the scale of the reaction tower 1 and the amount of the stock oil to be passed such that the contact time A is set to be longer than the contact time B.

In the present embodiment, it is preferable that the stock oil is passed to the reaction tower 1 such that the contact time A is set to be in a range of 10 seconds to 300 seconds and preferable that the stock oil is passed to the reaction tower 1 such that the contact time B is set to be in a range of 0.1 seconds to 5.0 seconds.

In the present specification, the contact time A is more preferably in a range of 10 seconds to 150 seconds, more preferably in a range of 15 seconds to 100 seconds, and particularly preferably in a range of 15 seconds to 50 seconds.

In a case where the contact time A between the stock oil A and the catalyst is in the above-described predetermined range, the aromatic components can be allowed to reliably react. Further, in a case where the contact time A is 300 seconds or shorter, accumulation of carbonaceous substances on the catalyst due to coking or the like can be suppressed. Further, the amount of light gas to be generated due to over decomposition can be suppressed.

The contact time B is preferably in a range of 0.1 seconds to 5.0 seconds, more preferably in a range of 0.5 seconds to 3.0 seconds, and still more preferably in a range of 0.75 seconds to 2.0 seconds.

In a case where the contact time B between the stock oil B and the catalyst is in the above-described predetermined range, further reaction of generated olefins is suppressed so that lower olefins can be produced from non-aromatic components with a high yield while generation of LPG and gas as by-products is suppressed.

The combination of the contact time A and the contact time B may be appropriately adjusted according to the type of stock oils to be passed and the above-described preferable contact times can be appropriately combined. As a preferable combination, for example, it is preferable that the contact time A is set to be in a range of 10 seconds to 150 seconds and the contact time B is set to be in a range of 0.1 seconds to 5.0 seconds, more preferable that the contact time A is set to be in a range of 10 seconds to 100 seconds and the contact time B is set to be in a range of 0.5 seconds to 3.0 seconds, and particularly preferable that the contact time A is set to be in a range of 10 seconds to 50 seconds and the contact time B is set to be in a range of 0.75 seconds to 2.0 seconds.

In the present embodiment, as described above, the effects of the present invention can be obtained by selecting two kinds of stock oils and catalytically cracking the stock oil A for a contact time (contact time A) set to be longer than the contact time for the stock oil B.

Further, three or more stock oils may be selected. In this case, the effects of the present invention can be obtained similar to the case of selecting two kinds of stock oils in a case where the contact time between the catalytic cracking catalyst and a stock oil having a larger aromatic component content among three or more stock oils is set to be longer.

In FIG. 1, one reaction tower in a catalytic cracking step 1 is illustrated, but a plurality of reaction towers 1 may be provided. For example, two or more reactors are provided, and the non-aromatic component reaction region 7 and the aromatic component reaction region 6 may be used as other reactors. In this case, the reactors may be arranged in series so that the stock oil A passes through both of the non-aromatic component reaction region 7 and the aromatic component reaction region 6. Alternatively, the reactors may be arranged in parallel so that the stock oil A passes through only the aromatic component reaction region 6 and the stock oil B passes through only the non-aromatic component reaction region 7. In a case where a plurality of reactors are provided, there is a disadvantage that the construction cost is increased. However, there is an advantage that the reaction conditions such as the reaction temperature and the reaction pressure can be individually controlled for each reactor and a suitable catalyst can be selected.

(Reaction Temperature)

The reaction temperature at which the stock oil A is brought into contact with the catalytic cracking catalyst for the reaction is not particularly limited, but it is preferable that the reaction temperature is set to be in a range of 400° C. to 650° C. In a case where the reaction temperature is 400° C. or higher, the stock oil is allowed to react easily. Further, the reaction temperature is more preferably 450° C. or higher.

In a case where the reaction temperature is 650° C. or lower, the yield of BTX can be sufficiently increased. Further, the reaction temperature is more preferably 600° C. or lower.

It is preferable that the reaction temperature at which the stock oil B is brought into contact with the catalytic cracking catalyst for the reaction is set to be in a range of 450° C. to 700° C. In a case where the reaction temperature is increased, the yield of the lower olefins can be increased. Further, the reaction temperature is more preferably 500° C. or higher.

Here, in a case where the reaction temperature is higher than 700° C., since coking tends to be intense, the reaction temperature is more preferably 650° C. or lower.

The reaction temperature of the stock oil A and the reaction temperature of the stock oil B are not necessarily separated, but the reaction temperatures of stock oils can be separated by providing reactors separately.

(Reaction Pressure)

The reaction pressure at which the stock oil is brought into contact with the catalytic cracking catalyst for the reaction is set to be preferably 1.5 MPaG or less and more preferably 1.0 MPaG or less. In a case where the reaction pressure is 1.5 MPaG or less, generation of light gas as a by-product can be suppressed, and the pressure resistance of a reaction device can be decreased. Further, it is preferable that the reaction pressure is greater than or equal to the normal pressure. In a case where the reaction temperature is set to be greater than or equal to the normal pressure, it is possible to prevent the device design from being complicated.

(Reaction Form)

Examples of the reaction form at the time of bringing the stock oil into contact with the catalytic cracking catalyst for the reaction include a fixed bed, a moving bed, and a fluidized bed. In a case where a fixed bed is selected as the reaction form, the catalytic activity is decreased due to the coke to be deposited on the catalyst, regeneration work for periodically burning and removing the coke on the catalyst may be performed. Meanwhile, in a case where a moving bed or a fluidized bed is selected as the reaction form, the form in which the coke deposed on the catalyst can be continuously removed, that is, a continuously regenerating fluidized bed in which the catalyst is circulated between a reactor and a regenerator so that reaction and regeneration can be continuously repeated may be used. Further, it is preferable that the stock oil in contact with the catalytic cracking catalyst is in a gas phase state. Further, the raw material may be diluted with the gas as necessary.

[Separation and Collection Step]

The separation and collection step of collecting lower olefins and monocyclic aromatic hydrocarbons having 6 to 8 carbon atoms from the product generated in the catalytic cracking step will be described.

The product generated in the reaction tower 1 is sent to the separation and collection step, that is, the collection system 2 through the line 8. The product contains gas containing lower olefins, BTX fractions, and heavy fractions having 9 or more carbon atoms. The product is separated into respective components through the collection system 2 so that lower olefins and BTX with added value are collected.

Any of known distillation devices and gas-liquid separation devices may be used for separation of the product into a plurality of fractions. As an example of a distillation device, a device capable of performing distillation and separation into a plurality of fractions using a multi-stage distillation device such as a stripper may be exemplified. As an example of a gas-liquid separation device, a device including a gas-liquid separation tank; a product introduction pipe which introduces the product into the gas-liquid separation tank; a gas component outflow pipe which is provided on the upper portion of the gas-liquid separation tank; and a liquid component outflow pipe which is provided in the lower portion of the gas-liquid separation tank may be exemplified.

In the separation and collection step, the product is separated into gas components (hydrocarbons having 1 to 4 carbon atoms) and liquid fractions so that lower olefins are collected from the gas components and BTX is collected from the liquid fractions. As an example of such a separation step, the product is mainly separated into gas components that include components (such as hydrogen, methane, ethane, and LPG) having 4 or less carbon atoms and liquid fractions, and lower olefins are purified and collected from the gas components. Further, the liquid components are separated into fractions containing BTX and heavy fractions having 9 or more carbon atoms through distillation, and BTX is purified and collected therefrom.

Further, even products other than the lower olefins and BTX can be collected and formed into products. Although not illustrated, for example, LPG fractions from lower paraffin may be separately collected. In addition, hydrogen as a by-product is collected and may be used for a hydrogen collection step described below. All of these can be collected according to known methods.

[Hydrogenation Reaction Step]

As described above, in a case where an oil having a large polycyclic aromatic hydrocarbon content among raw materials containing a large amount of aromatic components is used as a raw material, it is preferable that the polycyclic aromatic hydrocarbon is partially hydrogenated by performing a hydrogenation reaction step. In this case, since the hydrogenation reaction step is not an essential step of the present invention, the hydrogenation reaction device 3 is indicated by dotted lines in the figures.

In the hydrogenation reaction step, it is preferable that the polycyclic aromatic hydrocarbon is hydrogenated until the average number of aromatic rings becomes 1 or less. For example, it is preferable that hydrogenation is performed until naphthalene becomes tetralin (naphthenobenzene). Even in a case of alkyl naphthalene such as methylnaphthalene or dimethylnaphthalene, it is preferable that hydrogenation is performed until an aromatic hydrocarbon having one aromatic ring with naphthenobenzene, that is, a tetralin skeleton is obtained. Similarly, it is preferable that hydrogenation is performed until indenes become aromatic hydrocarbons having an indane skeleton, anthracenes become aromatic hydrocarbons having an octahydroanthracene skeleton, and phenanthrenes become aromatic hydrocarbons having an octahydrophenanthrene skeleton.

In a case where hydrogenation is performed until the average number of aromatic rings becomes 1 or less, the aromatic hydrocarbons are easily converted to BTX. In this manner, in order to increase the yield of BTX in the catalytic cracking step, the content of the polycyclic aromatic hydrocarbons in the hydrogenation reactant of the stock oil A obtained in the hydrogenation reaction step is set to be preferably 35% by mass or less, more preferably 25% by mass or less, and still more preferably 15% by mass or less.

A fixed bed is suitably employed as the reaction form in the hydrogenation reaction step.

As the hydrogenation catalyst, known hydrogenation catalysts (such as a nickel catalyst, a palladium catalyst, a nickel-molybdenum-based catalyst, a cobalt-molybdenum-based catalyst, a nickel-cobalt-molybdenum-based catalyst, and a nickel-tungsten-based catalyst) can be used.

The hydrogenation reaction temperature varies depending on the hydrogenation catalyst to be used, but is typically in a range of 100° C. to 450° C., more preferably in a range of 200° C. to 400° C., and still more preferably in a range of 250° C. to 380° C.

It is preferable that the hydrogenation reaction pressure is set to be in a range of 0.7 MPa to 13 MPa. Particularly, the hydrogenation reaction pressure is more preferably in a range of 1 MPa to 10 MPa and still more preferably in a range of 1 MPa to 7 MPa. In a case where the hydrogenation pressure is set to 13 MPa or less, a hydrogenation reactor in which the durable pressure is relatively low can be used, and the equipment cost can be reduced. Further, in a case where the hydrogenation pressure is set to 0.7 MPa or greater, the yield of hydrogenation reaction can be sufficiently and properly maintained.

The ratio between hydrogen and oil is preferably 4000 scfb (675 $Nm^3/m^3$) or less, more preferably 3000 scfb (506 $Nm^3/m^3$) or less, and still more preferably 2000 scfb (338 $Nm^3/m^3$) or less.

Further, the ratio thereof depends on the content of the polycyclic aromatic components in the stock oil provided for the hydrogenation reaction step, but is preferably 300 scfb (50 $Nm^3/m^3$) or greater from the viewpoint of the yield of the hydrogenation reaction.

The liquid hourly space velocity (LHSV) is preferably in a range of 0.1 $h^{-1}$ to 20 $h^{-1}$ and more preferably in a range of 0.2 $h^{-1}$ to 10 $h^{-1}$. In a case where LHSV is set to 20 $h^{-1}$ or less, the polycyclic aromatic hydrocarbons can be sufficiently hydrogenated under a lower hydrogenation reaction pressure. Meanwhile, in a case where the LHSV is set to 0.1 $h^{-1}$ or greater, it is possible to prevent an increase in size of the hydrogenation reactor.

(Catalytic Cracking Catalyst)

The catalytic cracking catalyst used in the present invention will be described. It is preferable that the catalytic cracking catalyst contains crystalline aluminosilicates.

Crystalline Aluminosilicate

As the crystalline aluminosilicates, small pore zeolites, medium pore zeolites, large pore zeolites, or ultra-large pore zeolites can be used. In a case where zeolites having a high BTX selectivity are used, usually, there is a concern that the yield of lower olefins is decreased. However, since lower olefins are produced by shortening the contact time in the present invention, the yield of the lower olefins are not greatly affected.

Here, examples of the small pore zeolites include zeolites having an ANA type crystal structure, a CHA type crystal structure, an ERI type crystal structure, a GIS type crystal structure, a KFI type crystal structure, an LTA type crystal structure, an NAT type crystal structure, a PAU type crystal structure, and a YUG type crystal structure.

The medium pore zeolites indicate zeolites having a 10-membered ring skeleton structure, and examples of the medium pore zeolites include zeolites having an AEL type crystal structure, an EUO type crystal structure, an FER type crystal structure, a HEU type crystal structure, an MEL type crystal structure, an MFI type crystal structure, an NES type crystal structure, a TON type crystal structure, and a WEI type crystal structure. Among these, from the viewpoint of further increasing the yield of BTX, an MFI type crystal structure is preferable.

The large pore zeolites indicate zeolites having a 12-membered ring skeleton structure, and examples of the large pore zeolites include zeolites having an AFI type crystal structure, an ATO type crystal structure, a BEA type crystal structure, a CON type crystal structure, an FAU type crystal structure, a GME type crystal structure, an LTL type crystal structure, an MOR type crystal structure, an MTW type crystal structure, and an OFF type crystal structure. Among these, a BEA type crystal structure, an FAU type crystal structure, and an MOR type crystal structure are preferable from the viewpoint of using industrially; and a BEA type crystal structure and an MOR type crystal structure are more preferable from the viewpoint of further increasing the yield of BTX.

Examples of the ultra-large pore zeolites include zeolites having a CLO type crystal structure and a VFI type crystal structure.

In a case where the reaction tower 1 is used for the reaction of a fixed bed, the content of the crystalline aluminosilicates in the catalytic cracking catalyst is preferably in a range of 60% to 100% by mass, more preferably in a range of 70% to 100% by mass, and particularly preferably in a range of 90% to 100% by mass with respect to 100% by mass of all catalytic cracking catalysts. In a case where the content of the crystalline aluminosilicates is 60% by mass or greater, the yield of BTX can be sufficiently increased.

In a case where the reaction tower 1 is used for the reaction of a fluidized bed, the content of the crystalline aluminosilicates in the catalytic cracking catalyst is preferably in a range of 20% to 80% by mass, more preferably in a range of 30% to 80% by mass, and particularly preferably in a range of 35% to 80% by mass with respect to 100% by mass of all catalytic cracking catalysts. In a case where the content of the crystalline aluminosilicates is 20% by mass or greater, the yield of BTX can be sufficiently increased. In a case where the content of the crystalline aluminosilicates is greater than 80% by mass, the content of the binder which can be blended into the catalyst is decreased, and this may become unsuitable for the reaction using a fluidized bed.

Added Metal

The catalytic cracking catalyst may contain added metals as necessary.

Examples of the form in which the catalytic cracking catalyst contains added metals include a form in which added metals are incorporated in the lattice skeleton of crystalline aluminosilicates, a form in which added metals are carried by crystalline aluminosilicates, and a form including both cases described above.

Phosphorus and Boron

It is preferable that the catalytic cracking catalyst contains phosphorus and/or boron. In a case where the catalytic cracking catalyst contains phosphorus and/or boron, a temporary decrease in the yield of lower olefins and BTX can be prevented, and coking on the surface of the catalyst can be suppressed.

Examples of the method of allowing the catalytic cracking catalyst to contain phosphorus include a method of allowing crystalline aluminosilicates to support phosphorus according to an ion exchange method or an impregnation method; a method of allowing crystalline aluminosilicates to contain a phosphorus compound at the time of zeolite synthesis and replacing a part of the inside of the skeleton of the crystalline aluminosilicates with phosphorus; and a method of using a crystal accelerator containing phosphorus at the time of zeolite synthesis. The phosphate ion-containing aqueous solution used at this time is not particularly limited, but an aqueous solution prepared by dissolving phosphoric acid, diammonium hydrogenphosphate, ammonium dihydrogen phosphate, or other water-soluble phosphates in water at an optional concentration can be preferably used.

Examples of the method of allowing the catalytic cracking catalyst to contain boron include a method of allowing crystalline aluminosilicates to support boron according to an ion exchange method or an impregnation method; a method of allowing crystalline aluminosilicates to contain a boron compound at the time of zeolite synthesis and replacing a part of the inside of the skeleton of the crystalline aluminosilicates with boron; and a method of using a crystal accelerator containing boron at the time of zeolite synthesis.

The content of the phosphorus and/or boron in the catalytic cracking catalyst is preferably in a range of 0.1% to 10% by mass, more preferably in a range of 0.5% to 9% by mass, and still more preferably in a range of 0.5% to 8% by mass with respect to 100% by mass of all catalysts. In a case where the content of phosphorus and/or boron is 0.1% by mass or greater, a temporary decrease in the yield can be prevented. Further, in a case where the content thereof is 10% by mass or less, the yield of lower olefins and BTX can be increased.

Shape

The catalytic cracking catalyst has a powder shape, a granular shape, or a pellet shape depending on the reaction form.

For example, the catalytic cracking catalyst has a powder shape in a case of a fluidized bed and has a granular shape or a pellet shape in a case of a fixed bed. The average particle diameter of the catalyst used for a fluidized bed is preferably in a range of 30 to 180 μm and more preferably in a range of 50 to 100 μm. Further, the bulk density of the catalyst used for a fluidized bed is preferably in a range of 0.4 to 1.8 $g/cm^3$ and more preferably in a range of 0.5 to 1.0 $g/cm^3$.

Further, the average particle diameter indicates a particle diameter which becomes 50% by mass in the particle size distribution obtained by classification using a sieve, and the bulk density is a value measured according to a method of JIS Standard R 9301-2-3.

In a case where a granular or pellet-like catalyst is obtained, as necessary, an oxide inert to the catalyst is blended as a binder and then the catalyst may be molded using various molding machines.

In a case where the catalytic cracking catalyst contains an inorganic oxide such as a binder, the catalytic cracking catalyst containing phosphorus as a binder may be used.

Second Embodiment

According to a second embodiment, a step of returning heavy fractions having 9 or more carbon atoms to the reactor 1 is performed after the catalytic cracking step described in the first embodiment.

Figure 2:
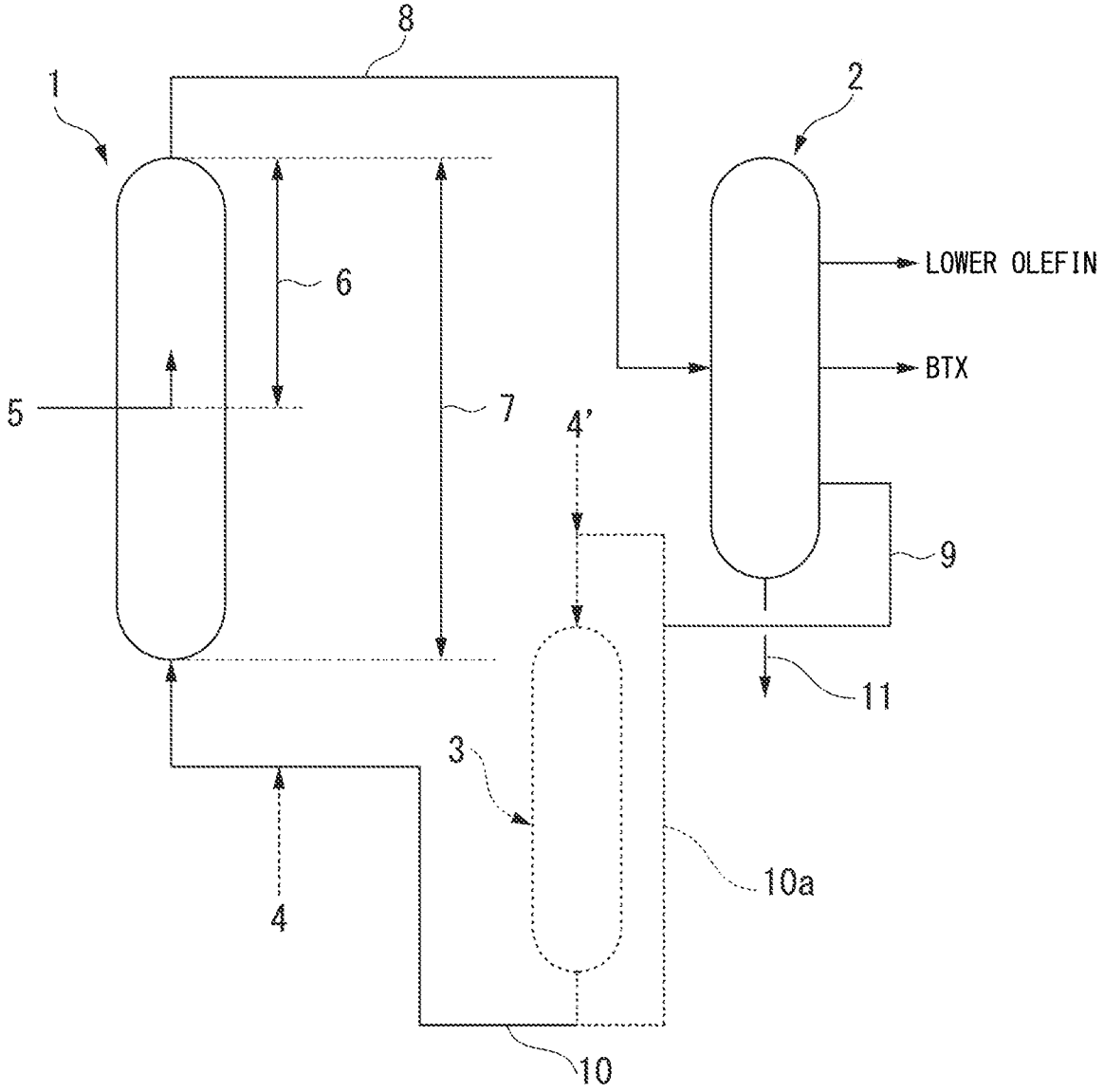
FIG. 2 is a schematic view for describing an embodiment of a device for producing a lower olefin and BTX according to the present invention.

FIG. 2 is a schematic view for describing an embodiment of a device for producing a lower olefin and BTX according to the present invention.

The schematic configuration of the embodiment of the device for producing a lower olefin and BTX according to the present invention and the processes according to the production method of the present invention will be described with reference to FIG. 2.

In a case where the content of the polycyclic aromatic hydrocarbon in the heavy fractions is small, the heavy fractions having 9 or more carbon atoms separated by the collection system 2 illustrated in FIG. 2 are returned to the reaction tower 1 through a line 9, a line 10*a*, and a recycle line 10 and can be provided for the catalytic cracking step.

Meanwhile, in a case where the content of the polycyclic aromatic hydrocarbon in the heavy fractions is large, it is preferable that the heavy fractions are sent to the hydrogenation reaction device 3 through a supply line 9 for the hydrogenation reaction step and then provided for the hydrogenation reaction step. In other words, the heavy fractions are partially hydrogenated by the hydrogenation reaction device 3, returned to the reaction tower 1 through the recycle line 10 for the catalytic cracking step, and then provided for the catalytic cracking reaction.

Therefore, according to the second embodiment, any of the line 10*a* or the hydrogenation reaction device 3 is necessarily required, but both of the line 10*a* and the hydrogenation reaction device 3 are not necessarily required. In this sense, the line 10*a* and the hydrogenation reaction device 3 in FIG. 2 are indicated by dotted lines. Here, both of the line 10*a* and the hydrogenation reaction device 3 may be provided.

Further, at the time of recycling the heavy fractions having 9 or more carbon atoms, for example, it is preferable that the heavy fractions having distillation properties and a 90 volume % distillation temperature (T90) of greater than 380° C. are cut by the collection system 2 and discharged from the line 11 so as not to be provided for the hydrogenation reaction step. Even in a case where fractions having a 90 volume % distillation temperature (T90) of greater than 380° C. are not almost contained, it is preferable that a certain amount of fractions are discharged to the outside of the system using the line 11 in a case where fractions with low reactivity are accumulated.

According to the second embodiment, the stock oil 5 (the stock oil B, a single oil or mixed oils formed of a plurality of oils may be employed) and heavy fractions (including those treated in the hydrogenation reaction step) having 9 or more carbon atoms which are generated in the catalytic cracking step and collected in the separation and collection step serve as the essential raw materials. Here, another stock oil A may be additionally treated.

In a case where the stock oil A (4 in FIG. 2) which is separate from the heavy fractions having 9 or more carbon atoms is additionally used and the content of the polycyclic aromatic components is in the range described in the "content of the polycyclic aromatic hydrocarbon" in the section of the "hydrogenation reaction step", the polycyclic aromatic components can be fed directly to the reactor 1 without being provided for the hydrogenation reaction step. Further, in a case where the stock oil A (4' in FIG. 2) whose content of the polycyclic aromatic components is larger than the range described in the "content of the polycyclic aromatic hydrocarbon" in the section of the "hydrogenation reaction step" is used, it is preferable that the polycyclic aromatic components are provided for the hydrogenation reaction device 3 so that the polycyclic aromatic components are partially hydrogenated, and the resulting components are fed to the reactor 1. In this case, it is not necessary that the hydrogenation reaction of the stock oil containing a large amount of polycyclic aromatic components and heavy fractions having 9 or more carbon atoms is carried out in the same reactor.

Third Embodiment

Figure 3:
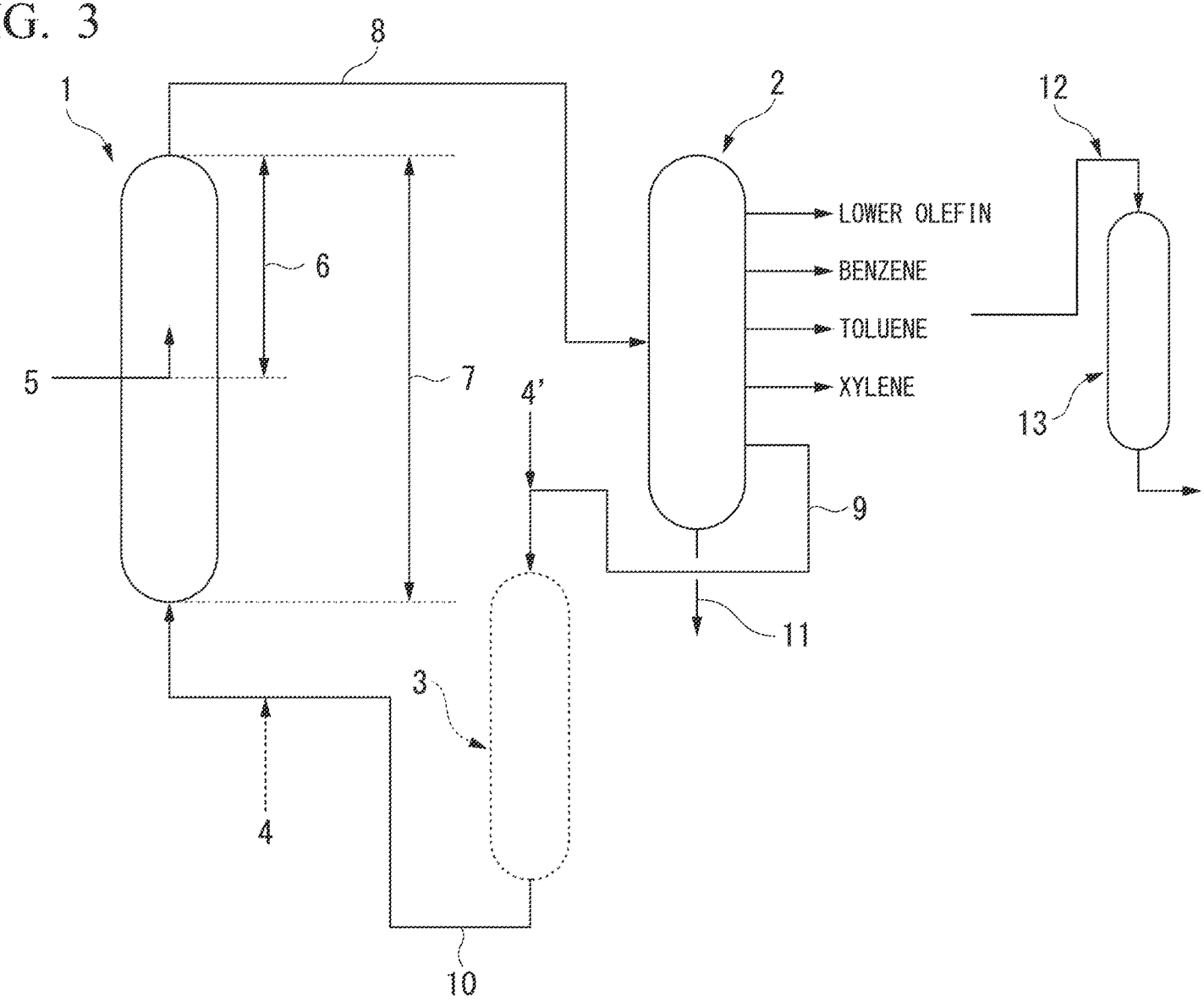
FIG. 3 is a schematic view for describing an embodiment of a device for producing a lower olefin and BTX according to the present invention.

According to a third embodiment, a step of producing benzene or xylene from toluene among BTX generated in the catalytic cracking step described in the first embodiment and the second embodiment is performed. FIG. 3 is a schematic view for describing an embodiment of a device for producing a lower olefin and BTX according to the present invention.

The schematic configuration of the embodiment of the device for producing a lower olefin and BTX according to the present invention and the processes according to the production method of the present invention will be described with reference to FIG. 3.

The toluene collected by the collection system 2 is sent to a toluene treatment step 13 through a line 12.

The toluene serves as a raw material of the aromatic components with high added value, such as benzene or xylene. Benzene or xylene can be produced by transalkylating the toluene. More specifically, in the toluene treatment step, a disproportion reaction between toluene on the catalyst, a transalkylation reaction of toluene and an aromatic compound having 9 or more carbon atoms, a dealkylation reaction of an alkyl aromatic compound having 9 or more carbon atoms, a transalkylation reaction between benzene and an aromatic compound having 9 or more carbon atoms, and the like occur at the same time. Because of these reactions, toluene is converted to benzene or xylene with high added value.

EXAMPLES

Hereinafter, the present invention will be described in more detail based on the following examples, but the present invention is not limited to the following examples.

<Production of Lower Olefin and BTX>

[Preparation Example of Catalytic Cracking Catalyst]

Preparation of Catalyst Containing Phosphorus-Supporting Crystalline Aluminosilicates A solution (A) containing 1706.1 g of sodium silicate (sodium J silicate No. 3 (product name), 28% to 30% by mass of $SiO_2$, 9% to 10% by mass of Na, remainder water, manufactured by Nippon Chemical Industrial Co., Ltd.) and 2227.5 g of water, and a solution (B) containing 64.2 g of $Al_2(SO_4)_3$.14 to $18H_2O$ (special grade reagent, manufactured by Wako Pure Chemical Industries, Ltd.), 369.2 g of tetrapropylammonium bromide, 152.1 g of $H_2SO_4$ (97% by mass), 326.6 g of NaCl, and 2975.7 g of water were respectively prepared.

Next, the solution (B) was gradually added to the solution (A) while the solution (A) is stirred at room temperature.

The obtained mixture was violently stirred using a mixer for 15 minutes, and the gel was disintegrated in a milky homogeneous fine state.

Next, this mixture was put into a stainless steel autoclave and sealed, and a crystallization operation was performed under self-pressure by setting the temperature to 165° C., the time to 72 hours, and the stirring speed to 100 rpm. After the crystallization operation was completed, the product was filtered, and the solid product was collected. Further, the product was repeatedly washed and filtered five times using approximately 5 L of deionized water. The solid matter obtained by filtration was dried at 120° C. and burned at 550° C. for 3 hours under an air-circulating condition.

As the result of X-ray diffraction analysis (model name: Rigaku RINT-2500V), it was confirmed that the obtained burned material had an MFI structure. Further, the ratio (molar ratio) between $SiO_2$ and $Al_2O_3$ which was obtained by fluorescent X-ray analysis (model name: Rigaku ZSX101e) was 64.8. In addition, the aluminum elements contained in the crystalline aluminosilicates calculated from the results was 1.32% by mass.

Next, a 30 mass % aluminum nitrate aqueous solution was added to the obtained burned material at a rate of 5 mL of the aqueous solution per 1 g of the burned material, heated at 100° C. for 2 hours, stirred, filtered, and washed with water. This operation was repeated four times, and the resultant was dried at 120° C. for 3 hours, thereby obtaining ammonium type crystalline aluminosilicates.

Thereafter, the ammonium type crystalline aluminosilicates were burned at 780° C. for 3 hours to obtain proton type crystalline aluminosilicates.

Next, 30 g of the obtained proton type crystalline aluminosilicates were impregnated with 30 g of a diammonium hydrogenphosphate aqueous solution such that 0.7% by mass of phosphorus (a value obtained by setting the total mass of crystalline aluminosilicates to 100% by mass) was supported, and the resultant was dried at 120° C. Thereafter, the resultant was burned at 780° C. for 3 hours under an air-circulating condition, thereby obtaining a catalytic cracking catalyst containing crystalline aluminosilicates and phosphorus.

Example 1

Lower olefins and BTX were produced according to the production method described in the first embodiment illustrated in FIG. 1.

Lower olefins and BTX were produced by introducing each of the stock oil 5 (the stock oil B: light kerosene fractions discharged from a cracker, described as "stock oil 5-*i*" in Table 1) in FIG. 1 and the stock oil 4 (the stock oil A: hydrogenated oil of light kerosene fractions obtained from a thermal cracker, described as "stock oil 4-*i*" in Table 1) in FIG. 1 into a reactor, and bringing the stock oil into contact with a catalyst for the reaction under a reaction temperature condition for each contact time (the contact time A and the contact time B) listed in Table 1 at a reaction pressure of 0.1 MPa using a flow-type reaction apparatus (corresponding to the reference numeral 1 in FIG. 1) obtained by filling a reactor with 50 mL of the catalytic cracking catalyst obtained in the preparation example of the catalytic cracking catalyst. Here, the stock oil 5 was introduced from a position corresponding to the reference numeral 5 in FIG. 1 and the stock oil 4 was introduced from a position corresponding to the inlet of the reaction tower 1 in FIG. 1. The stock oil 4 and the stock oil 5 were supplied to the reactor at a volume ratio of 3:1.

Here, the contact time of the non-aromatic component reaction region 7 was controlled to be the contact time B (the contact time B: 1 second) listed in Table 1.

Further, the stock oil 4 containing a large amount of aromatic components was supplied to the reactor such that the contact time of the aromatic component reaction region 6 was set to the contact time A (the contact time A: 20 seconds) listed in Table 1. After a certain time had elapsed, the product was collected for a certain time, and the yield of various products with respect to the total value of the supply amount of the stock oil 4 and the stock oil 5 per unit time was acquired.

Comparative Example 1

Lower olefins and BTX were produced by bringing the stock oil into contact with a catalyst for the reaction according to the same method as that of Example 1 except that the position of the stock oil 5 to be introduced into a flow-type reaction apparatus 1 was changed to the same position as that for the stock oil 4 from the position corresponding to the reference numeral 5 in FIG. 1.

Examples 2 to 8

Lower olefins and BTX were produced according to the production method described in the second embodiment illustrated in FIG. 2.

Lower olefins and BTX were produced by introducing the stock oil 5 (the stock oil B: light kerosene fractions discharged from a cracker, described as the stock oils 5-*i* to 5-*iii* listed in Table 1) in FIG. 2 into a reactor, and bringing the stock oil into contact with a catalyst for the reaction under a reaction temperature condition for each contact time (the contact time A and the contact time B) listed in Table 1 at a reaction pressure of 0.1 MPa using a flow-type reaction apparatus (corresponding to the reference numeral 1 in FIG. 2) obtained by filling a reactor with 50 mL of the catalytic cracking catalyst obtained in the preparation example of the catalytic cracking catalyst.

Here, the stock oil 5 was introduced to the flow-type reaction apparatus 1 from a position corresponding to the reference numeral 5 (the inlet of the non-aromatic component reaction region) in FIG. 2, and the contact time thereof was controlled to be the contact time (the contact time B: 0.5 to 3 seconds) listed in Table 1.

After the reaction was stabilized, the obtained product was collected for a certain time, and the composition of the product was analyzed by FID gas chromatograph.

Next, heavy fractions having 9 or more carbon atoms were separated from the collected liquid product, and the heavy fractions having 9 or more carbon atoms were subjected to a hydrogenation reaction. The hydrogenation was carried out by setting the hydrogenation temperature to 340° C., the hydrogenation pressure to 5 MPaG, and LHSV to 1.2 $h^{-1}$ using a commercially available nickel-molybdenum catalyst.

Subsequently, a hydride (the stock oil A, hereinafter, referred to as "$C_{9+}$ hydrogenated oil") of the heavy fractions having 9 or more carbon atoms was recycled to the reactor 1 through the line 10. In other words, the halide was supplied to the reactor from the position corresponding to the reference numeral 4 of FIG. 2, and BTX was produced under the reaction conditions (538° C., the contact time A of the present application: 20 seconds) listed in Table 1 (aromatic component reaction region).

After the reaction was stabilized, the obtained product was collected for a certain time, and the composition of the product was analyzed by FID gas chromatograph.

The yield of various products with respect to the supply amount of the stock oil 5 per unit time after a certain time was acquired by continuously performing the above-described operation.

Comparative Example 2

Lower olefins and BTX were produced by bringing the stock oil into contact with a catalyst for the reaction according to the same method as that of Example 3 except that the position of the stock oil 5 in FIG. 2 to be introduced into the flow-type reaction apparatus 1 was changed to the same position as that for the stock oil 4 from the position corresponding to the reference numeral 5 in FIG. 2.

TABLE 1

| | | | Example 1 | Comparative Example 1 | Example 2 | Example 3 | Example 4 |
|---|---|---|---|---|---|---|---|
| Corresponding embodiment | | | First embodiment | — | Second embodiment | Second embodiment | Second embodiment |
| Recycle step for heavy fractions having 9 or more carbon atoms | | | Not performed | Not performed | Performed | Performed | Performed |
| Stock oil | Stock oil 5 (stock oil B) | Type of stock oil | Stock oil 5-i | Stock oil 5-j | Stock oil 5-jj | Stock oil 5-i | Stock oil 5-iii |
| | | Content of non-aromatic components (%) | 41 | 41 | 21 | 41 | 50 |
| | | Content of aromatic components (%) | 59 | 59 | 79 | 59 | 50 |
| | Stock oil 4 (stock oil A) | Type of stock oil | Stock oil 4-i | Stock oil 4-i | $C_9^+$ hydrogenated oil | $C_9^+$ hydrogenated oil | $C_9^+$ hydrogenated oil |
| | | Content of aromatic components (%) | 98 | 98 | 95 | 69 | 59 |
| Reaction condition | Non-aromatic component reaction region | Reaction temperature (° C.) | 550 | — | 550 | 550 | 550 |
| | | Contact time B (sec) | 1 | — | 1 | 1 | 1 |
| | Aromatic component reaction region | Reaction temperature (° C.) | 538 | 538 | 538 | 538 | 538 |
| | | Contact time A (sec) | 20 | 20 | 20 | 20 | 20 |
| Reaction results | | Yield of lower olefin (C2 to C4) (%) | 19 | 3 | 19 | 23 | 27 |
| | | Yield of BTX (%) | 26 | 41 | 56 | 55 | 49 |
| | | Total value of yield of BTX and yield of lower olefin (%) | 45 | 44 | 75 | 78 | 76 |
| | | Yield of lower paraffin (C1 to C4) (%) | 7 | 23 | 17 | 12 | 14 |

| | Example 5 | Example 6 | Example 7 | Example 8 | Comparative Example 2 |
|---|---|---|---|---|---|
| Corresponding embodiment | Second embodiment | Second embodiment | Second embodiment | Second embodiment | — |
| Recycle step for heavy fractions having 9 | Performed | Performed | Performed | Performed | Performed |

TABLE 1-continued

| | | | | | | | |
|---|---|---|---|---|---|---|---|
| | or more carbon atoms | | | | | | |
| Stock oil | Stock oil 5 (stock oil B) | Type of stock oil | Stock oil 5-i | Stock oil 5-i | Stock oil 5-i | Stock oil 5-i | Stock oil 5-i |
| | | Content of non-aromatic components (%) | 41 | 41 | 41 | 41 | 41 |
| | | Content of aromatic components (%) | 59 | 59 | 59 | 59 | 59 |
| | Stock oil 4 (stock oil A) | Type of stock oil | $C_9^+$ hydrogenated oil | $C_9^+$ hydrogenated oil | $C_9^+$ hydrogenated oil | $C_9^+$ hydrogenated oil | $C_9^+$ hydrogenated oil |
| | | Content of aromatic components (%) | 63 | 74 | 64 | 79 | 94 |
| Reaction condition | Non-aromatic component reaction region | Reaction temperature (° C.) | 500 | 600 | 550 | 550 | — |
| | | Contact time B (sec) | 1 | 1 | 0.5 | 3 | — |
| | Aromatic component reaction region | Reaction temperature (° C.) | 538 | 538 | 538 | 538 | 538 |
| | | Contact time A (sec) | 20 | 20 | 20 | 20 | 20 |
| Reaction results | | Yield of lower olefin (C2 to C4) (%) | 17 | 23 | 19 | 14 | 4 |
| | | Yield of BTX (%) | 56 | 55 | 56 | 60 | 60 |
| | | Total value of yield of BTX and yield of lower olefin (%) | 73 | 78 | 75 | 74 | 64 |
| | | Yield of lower paraffin (C1 to C4) (%) | 15 | 14 | 9 | 20 | 31 |

As listed in Table 1, in Example 1 to which the first embodiment of the present invention was applied, the total value of the yield of lower olefins and the yield of BTX was higher compared to the result of Comparative Example 1 to which the present invention was not applied. Further, the yield of lower paraffin as a by-product gas was 7% in Example 1, which was greatly reduced, but the yield thereof was 23% in Comparative Example 1.

Further, in all Examples 2 to 8 to which the second embodiment of the present invention was applied, the yield of lower paraffin as a by-product gas was 20% or less, which was suppressed to be low, and the total value of the yield of lower olefins and the yield of BTX was 73% or greater, which was high.

On the contrary, in Comparative Example 2 to which the present invention was not applied, lower paraffin was generated by 31%, and the yield of lower olefins and BTX was 64% which was lower than the results of Examples 2 to 8 by approximately 10% even though the content of the non-aromatic components in the stock oil 5 was the same as the content in Example 3 and Examples 5 to 8.

The invention claimed is:

1. A method of producing lower olefins and monocyclic aromatic hydrocarbons having 6 to 8 carbon atoms from stock oils selected from at least two or more kinds of oils, the method comprising:

a first catalytic cracking step of bringing one stock oil A among the stock oils into contact with a catalytic cracking catalyst;

a second catalytic cracking step of bringing one stock oil B into contact with the catalytic cracking catalyst; and a separation and collection step of collecting the lower olefins and the monocyclic aromatic hydrocarbons having 6 to 8 carbon atoms from a product generated in the first and second catalytic cracking steps, wherein the first catalytic cracking step and the second catalytic cracking step are conducted in a single reaction tank, wherein the stock oil A contains 59% by mass or greater of an aromatic component, wherein the stock oil B contains 15% by mass or greater of a non-aromatic component and 50% by mass or greater of an aromatic component, provided that the content of the aromatic component contained in the stock oil B is 90% or less with respect to the total amount of the aromatic components contained in the stock oil A, wherein a contact time A during which the stock oil A is in contact with the catalytic cracking catalyst in the first catalytic cracking step is in a range of 15 seconds to 300 seconds, and wherein a contact time B during which the stock oil B is in contact with the catalytic cracking catalyst in the second catalytic cracking step is in a range of 0.1 seconds to 5.0 seconds.

2. The method according to claim 1, wherein the stock oil A contains heavy fractions having 9 or more carbon atoms collected in the separation and collection step are recycled to the stock oil A.

3. The method according to claim 1, further comprising:

a step of producing benzene or xylene from toluene after the separation and collection step.

4. The method according to claim 1, wherein the catalytic cracking catalyst is a catalyst containing crystalline aluminosilicates.

* * * * *